US008684071B2

(12) United States Patent
Andersson et al.

(10) Patent No.: US 8,684,071 B2
(45) Date of Patent: Apr. 1, 2014

(54) END PLATE FOR PLATE HEAT EXCHANGER

(75) Inventors: Sven Andersson, Hässleholm (SE); Tomas Dahlberg, Helsingborg (SE)

(73) Assignee: Swep International AB, Landskrona (SE)

( * ) Notice: Subject to any disclaimer, the term of this patent is extended or adjusted under 35 U.S.C. 154(b) by 884 days.

(21) Appl. No.: 11/990,753

(22) PCT Filed: Aug. 18, 2006

(86) PCT No.: PCT/SE2006/050288

§ 371 (c)(1),
(2), (4) Date: Apr. 16, 2008

(87) PCT Pub. No.: WO2007/024191

PCT Pub. Date: Mar. 1, 2007

(65) Prior Publication Data

US 2009/0107661 A1 Apr. 30, 2009

(30) Foreign Application Priority Data

Aug. 26, 2005 (SE) ..... 0501908

(51) Int. Cl.
*F28D 9/00* (2006.01)
*F28F 3/08* (2006.01)
*F28F 3/04* (2006.01)

(52) U.S. Cl.
CPC ..... *F28D 9/005* (2013.01); *F28F 3/046* (2013.01); *Y10S 165/906* (2013.01)
USPC ..... 165/167; 165/906

(58) Field of Classification Search
USPC ..... 165/166, 167
See application file for complete search history.

(56) References Cited

U.S. PATENT DOCUMENTS

| | | | | |
|---|---|---|---|---|
| 2,039,216 | A * | 4/1936 | Feldmeier | 165/167 |
| 2,937,856 | A * | 5/1960 | Thomson | 165/66 |
| 3,537,165 | A | 11/1970 | Paddock et al. | |
| 3,731,737 | A * | 5/1973 | Jenssen | 165/167 |
| 4,011,905 | A | 3/1977 | Millard | |
| 4,176,713 | A * | 12/1979 | Fisher | 165/166 |
| 4,434,643 | A * | 3/1984 | Almqvist et al. | 72/379.6 |
| 4,987,955 | A * | 1/1991 | Bergqvist et al. | 165/167 |
| 5,988,269 | A | 11/1999 | Karlsson et al. | |
| 6,516,874 | B2 * | 2/2003 | Mathur et al. | 165/166 |

(Continued)

FOREIGN PATENT DOCUMENTS

| | | |
|---|---|---|
| CN | 1102287 | 5/1995 |
| EP | 0 088 316 | 9/1983 |

(Continued)

OTHER PUBLICATIONS

European Search Report for corresponding European Application No. 06 76 9666 mailed Mar. 12, 2010.
Chinese Office Action for corresponding Chinese Application No. 200680031252.4 mailed May 22, 2009.

*Primary Examiner* — Allen Flanigan
(74) *Attorney, Agent, or Firm* — Merchant & Gould P.C.

(57) ABSTRACT

An end plate (200, 300) for a brazed heat exchanger comprises a relief pattern comprising ridges (230, 330) and grooves (240, 340) pressed into the plate material. The relief pattern (330, 340) is symmetric.

5 Claims, 5 Drawing Sheets

(56) References Cited

U.S. PATENT DOCUMENTS

| | | | | |
|---|---|---|---|---|
| 6,702,005 | B1 | 3/2004 | Blomgren | |
| 6,823,934 | B2 * | 11/2004 | Andersson | 165/167 |
| 7,044,206 | B2 | 5/2006 | Sabin et al. | |
| 2004/0069837 | A1 | 4/2004 | Fujiyama et al. | |
| 2004/0168793 | A1 * | 9/2004 | Blomgren | 165/167 |
| 2008/0257536 | A1 * | 10/2008 | Kolblin et al. | 165/167 |

FOREIGN PATENT DOCUMENTS

| | | |
|---|---|---|
| EP | 1 426 722 | 6/2004 |
| GB | 2 111 187 | 6/1983 |
| JP | 10-153358 | 6/1988 |
| WO | WO 88/01722 | 3/1988 |
| WO | WO 2005071342 A1 * | 8/2005 |

* cited by examiner

END PLATE FOR PLATE HEAT EXCHANGER

FIELD OF THE INVENTION

The present invention relates to an end plate for a brazed heat exchanger. The end plate comprises a relief pattern comprising ridges and grooves pressed into the plate material.

PRIOR ART

In the art of brazed plate heat exchangers, a number of heat exchanger plates are stacked onto one another to form a heat exchanger package. On the top and on the bottom of the stack, end plates are placed. The function of the end plates is twofold; firstly, the end plate should seal the heat exchanger package, and secondly, it should provide enough strength to withstand internal pressure from the media to be heat exchanged.

In most heat exchanger of this type, the heat exchanger package comprises a number of identical plates, where every other plate is rotated 180 degrees compared to the two neighbouring plates. This arrangement, combined with the fact that each heat exchanger plate comprises four holes provided near the corners of the heat exchanger plates, wherein two holes are arranged at areas elevated from the plate, results in heat exchanger channels being formed, in a way that is well known by persons skilled in the art.

In most cases, the heat exchanger plates are provided with a "fish-bone" pattern, which is relief-printed on the heat exchanger plate. The height of the fish-bone pattern equals the height of the area where two of the holes are provided. The arrangement of the fish-bone pattern, combined with the fact that every other plate is rotated 180 degrees compared to its neighbouring plates results in brazing points, i.e. points where the fish-bone patterns of two neighbouring plates contact one another, being spread out relative even over the entire fish-bone pattern.

In order to save material and reduce the space occupied by each heat exchanger, there are solutions where the end plates are designed to allow a flow between itself and the neighbouring heat exchanger plate. This is achieved by providing the end plate with a fish-bone pattern that is identical to the fish-bone pattern of the heat exchanger plate.

One drawback with the end plates according to the prior art is that it is necessary to rotate the end plate compared to the neighbouring heat exchanger plate.

SUMMARY OF THE INVENTION

In order to solve the above problems, an end plate according to the invention comprises a symmetric relief pattern.

BRIEF DESCRIPTION OF THE DRAWING

Below, the invention will be described with reference to the appended drawings, wherein.

DESCRIPTION OF PREFERRED EMBODIMENTS

Figure 1:
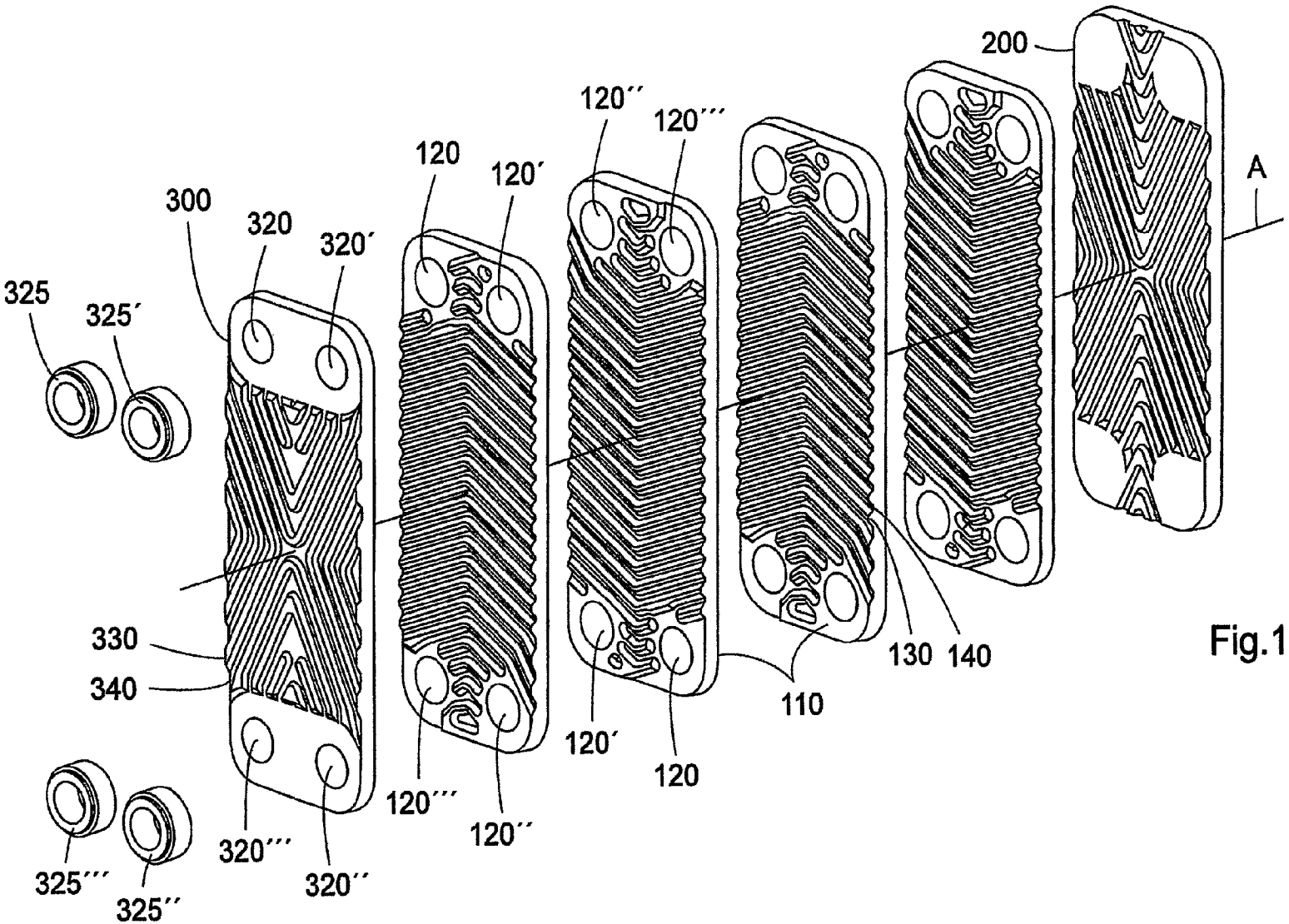
FIG. 1 is an exploded perspective view showing a heat exchanger with end plates according to the present invention.

With reference to FIG. 1, a brazed plate heat exchanger comprises at least one end plate 200, 300 according to the present invention and a number (in this case four) of heat exchanger plates 110. Each heat exchanger plate 110 comprises four openings 120, 120', 120", 120'". On neighbouring plates, the openings of one plate connects to other opening on the other plate, so that the opening 120 of one plate connects to the openings 120" on neighbouring plates, and the opening 120' of one plate connects to the openings 120'" on it neighbouring plates.

Due to the fact that the openings 120' and 120" are located on an elevated surface, there will only be contact between every other connection 120' and 120'". The neighbouring connections 120', 120'" will leave an opening into a fishbone pattern comprising relief printed ridges 130 and grooves 140. Since there is a correspondent opening between the openings 120 and 120" on the other end of the heat exchanger plates, there will be a channel through the fishbone pattern, connecting the opening pairs 120' 120'" and 120, 120".

On the end plate 300, there are four openings 320, 320', 320", 320'", which are located to communicate with the corresponding openings 120, 120', 120", 120'" on the neighbouring heat exchanger plate 110. Four connections 325, 325', 325", 325'" connect to the openings 320, 320', 320", 320'", respectively. Since the openings 120' and 120" are elevated, there will be no opening to the fishbone pattern of the neighbouring heat exchanger plate 110. However, there will be an opening to the fishbone pattern from the area defined by the openings 320, 120, and the openings 320'", 120'". As can be seen in FIG. 1, there is a relief pattern comprising ridges 330 and grooves 340 provided on the end plate 300. According to the invention, this relief pattern is not a fish-bone pattern, as is the case for prior art end plate relief patterns, but a pattern that is substantially symmetrical around an axis A extending through the heat exchanger plates 110 and the end plates 200, 300. As can be understood, this means that it is not possible to place the endplate wrong compared to the heat exchanger plates 110, which is possible if the end plate is provided with a prior art fish-bone pattern.

As can be understood by persons skilled in the art, it is necessary to seal off the openings defined by the openings 320, 320', 320", 320'", 120, 120', 120", 120'". According to the invention, this is done by the end plate 200. The end plate 200 is identical to the end plate 300, except for the provision of openings in the end plate 300. The end plate 200 is provided with an identical relief printed pattern as the end plate 300.

As mentioned in the prior art section, the heat exchanger is brazed; this is done by a single brazing, wherein a stack comprising a number of heat exchanger plates 110 and at least two end plates 200, 300 are placed in a brazing oven. Usually, sheets of brazing material are placed between said components. During the brazing, the brazing material will melt, and hence braze areas of the components that are in physical contact, or located close to one another.

Figure 2:
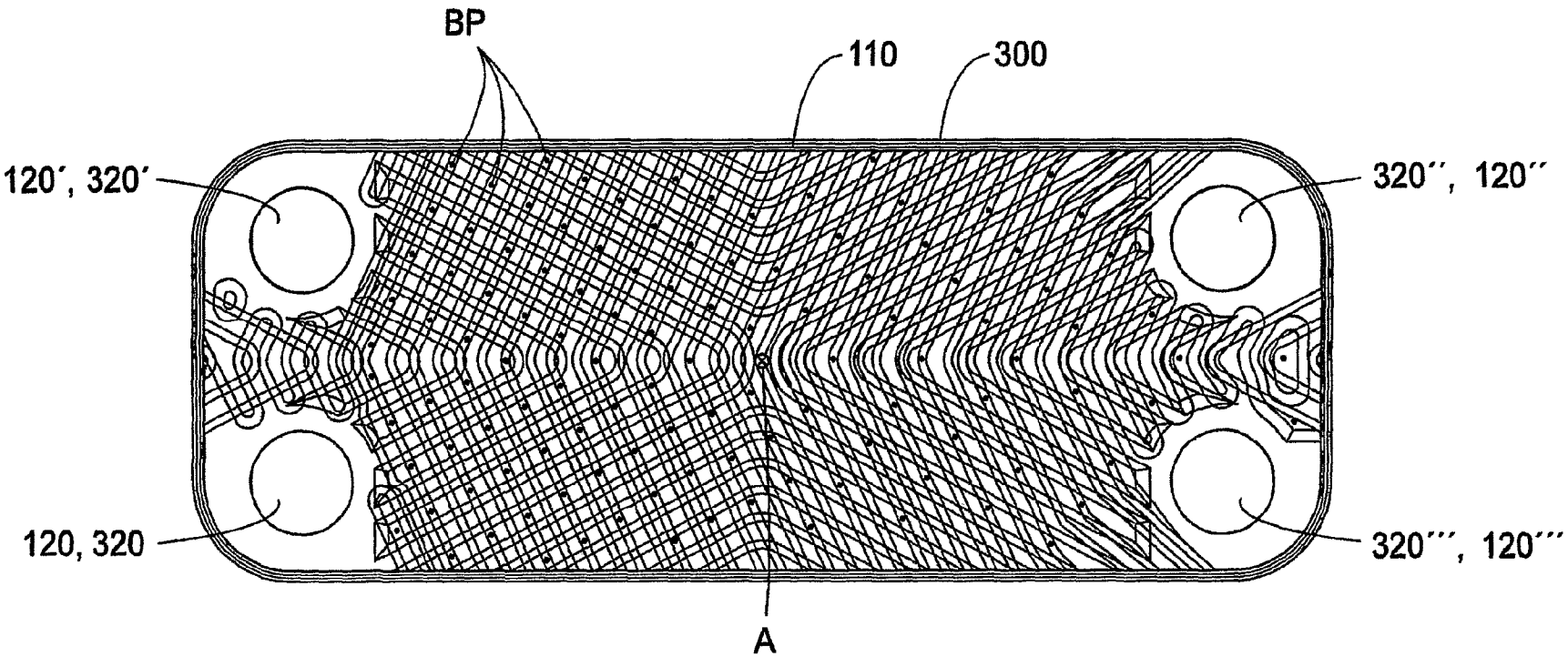
FIG. 2 is a plan view of a fish-bone pressed heat exchanger plate interposed on an end plate according to the present invention.

For prior art end plates, the neighbouring heat exchanger plate is brazed to the end plate on brazing points defined by the fish-bone pattern provided on both the prior art end plate and the heat exchanger plate. This results in a brazing point pattern that is equally dense over the entire area of the prior art end plate and the heat exchanger plate. For the end plate according to the invention, this is not always the case. In FIG. 2, brazing points BP between an end plate according to the end plate 300 shown in FIG. 1 and a heat exchanger plate 110 is shown. As can be seen, the brazing point distribution is more dense on the left side of the end plate/heat exchanger plate, i.e. where the angle between the fish-bone pattern and the end plate pattern is close to 90 degrees. On the right side of the end plate/heat exchanger plate, the distribution of brazing points BP is less dense. As can be seen, there are relatively large areas around the openings 120', 320' and 320", 120" that are brazed. As mentioned earlier, this means that there is no connection between these openings and the space between the end plate 200 and the heat exchanger plate 110, whereas the opposite is true for the openings 120, 320 and 320''', 120'''.

The above leads to a vital conclusion; it is essential that the relief printed pattern of the end plate differs angularly compared to the angle of the fish-bone pattern; else, there will either be no brazing point between the end plate 200 and the heat exchanger plate 110, or very long brazing points that will seal a substantial area of the passage between the end plate and the heat exchanger plate. Neither of this is beneficial; if there are no brazing points, the heat exchanger will be weak, and if there are very long brazing points, the performance of the heat exchanger will be impaired.

Figure 3:
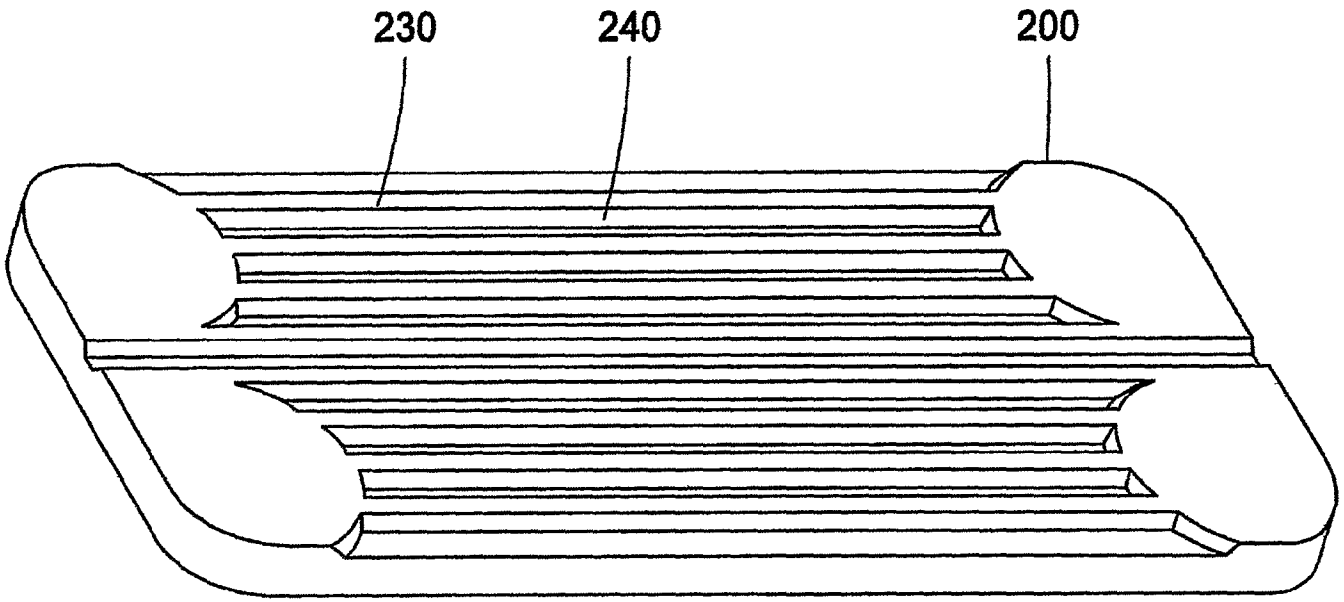
FIG. 3-5 are plan views of different embodiments of end plates according to the present invention.
Figure 4:
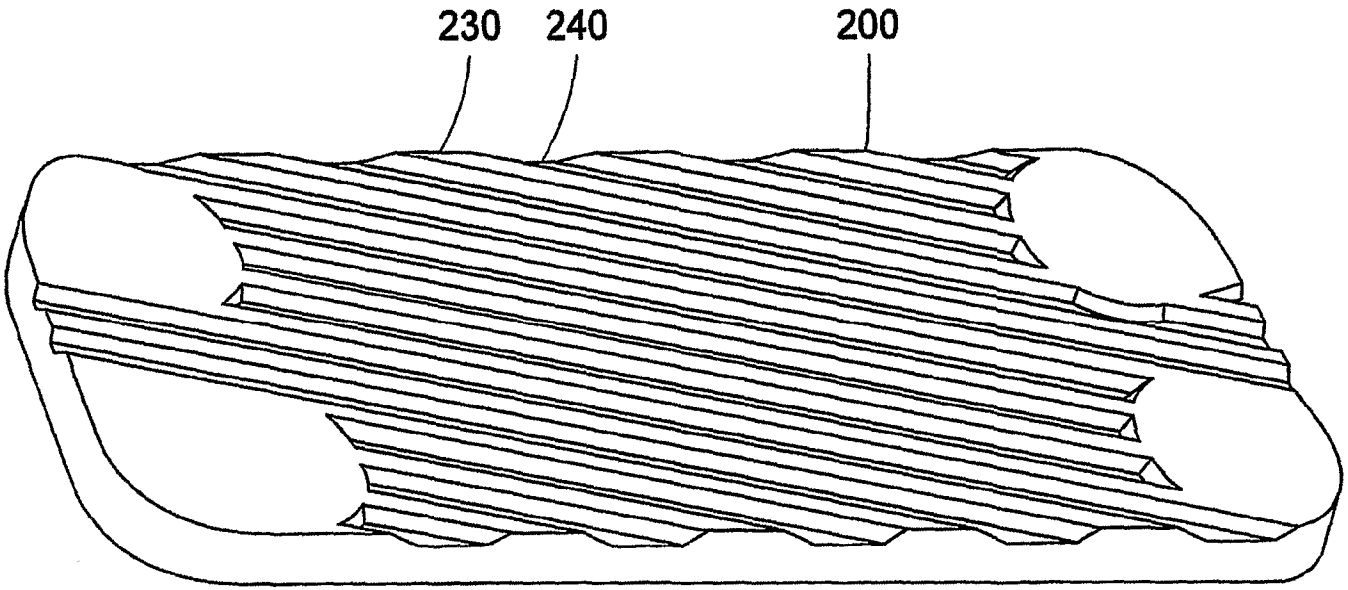

In FIGS. 3 and 4, two different relief print patterns of end plates 200 are shown. In FIG. 3, ridges 230 and grooves 240 run in straight lines from one end of the end plate to the other end of the end plate. This pattern is beneficial in that there will be an equal brazing point density over the entire end plate area, provided that the heat exchanger plate to which the end plate should be brazed is provided with a fish-bone pattern.

In FIG. 4, the ridges 230 and grooves 240 run in an angle relative to the end plate 200. This design gives an uneven distribution of the brazing points BP, but is beneficial in that a higher thermal performance can be achieved.

Figure 5:
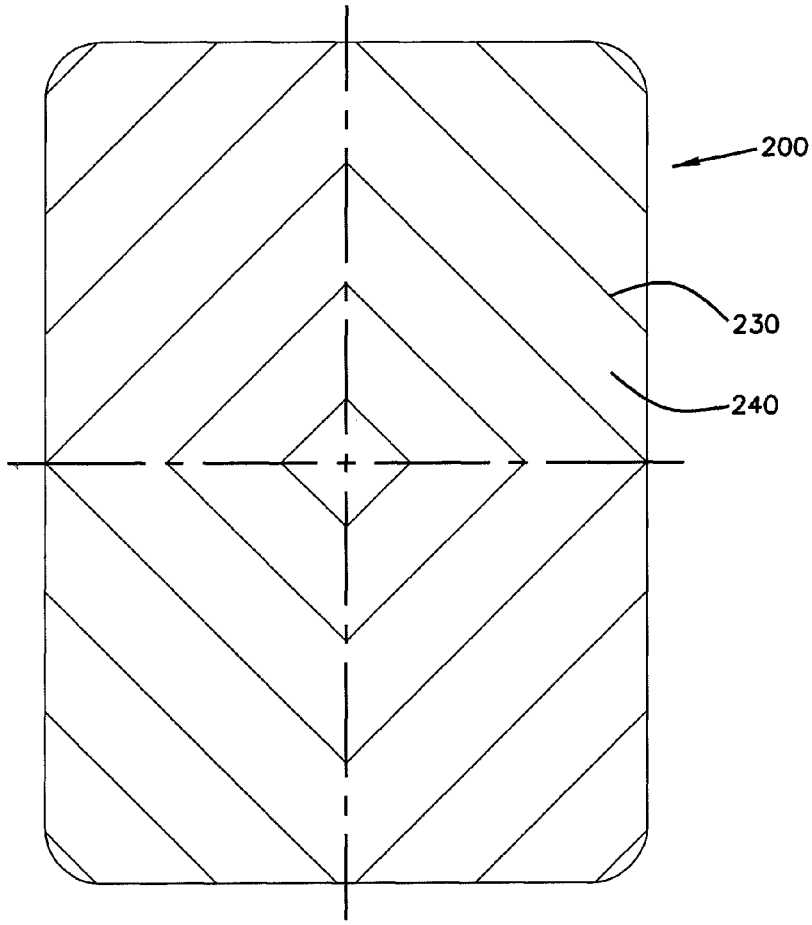

In FIG. 5, the end plate 200 includes ridges 230 and grooves 240 that form two arrow patterns that point away from one another.

Common for all showed embodiments of the end plates 200 and 300 is that the end plates are symmetrical with respect to the axis A, i.e. it does not matter whether the end plate is rotated 180 degrees about this axis. This is very beneficial from a manufacturing point of view, since it reduces the risk of mistakes regarding the positioning of the end plate.

As should be obvious for any persons skilled in the art, it is not necessary to use two end plates according to the present invention; in some cases, it might be advantageous to use one end plate according to the present invention and one end plate according to the prior art. It could also be beneficial to use one end plate with straight grooves (as in FIG. 3) and one end plate with angled groove (as in FIG. 4).

The invention is further not limited to heat exchangers having connection on one end plate only; it is equally beneficial to use the end plates according to the present invention for heat exchanger having connections on both end plates.

The invention claimed is:

1. A brazed heat exchanger comprising a first end plate, a second end plate, and a plurality of heat exchanger plates between the first end plate and the second end plate, wherein one of the plurality of heat exchanger plates is a herringbone patterned heat exchanger plate adjacent and brazed to the first end plate and another one of the plurality of heat exchanger plates is a herringbone patterned heat exchanger plate adjacent and brazed to the second end plate, wherein angles formed by ridges in the herringbone pattern of the one of the plurality of the heat exchanger plates and the another of the plurality of heat exchanger plates are the same along an entire length of the one of the plurality of heat exchanger plates and the another one of the plurality of heat exchanger plates, wherein the first end plate and the second end plate each comprise a pressed pattern of ridges and grooves, wherein the first end plate and the second end plate are end plates limited by two long sides and two short sides and wherein media to be heat exchanged flow mainly parallel to the long sides, the pattern of the end plates comprising two arrow patterns wherein each arrow pattern comprises at least two segments of ridges that meet to define angles, wherein the angles of the ridges in the at least two segments are arranged on opposite sides of the end plates relative to a first axis, and mirrors symmetrically about the first axis and a second axis, wherein the first axis extends between the two long sides and the second axis extends between the two short sides, and wherein the angles substantially differ from a corresponding angle of the herringbone patterned heat exchanger plate adjacent and brazed to the end plates.

2. The end plates according to claim 1, wherein the two arrow patterns point towards one another.

3. The end plates according to claim 1, wherein the two arrow patterns point away from one another.

4. The end plates according to claim 1, wherein the pressed pattern of the first end plate is identical to the pressed pattern of the second end plate.

5. The brazed heat exchanger according to claim 1, wherein the herringbone pattern of the one of the plurality of heat exchanger plates and the another one of the plurality of heat exchanger plates mirrors symmetrically about a vertical axis.

* * * * *